US006969320B2

(12) United States Patent
Lind et al.

(10) Patent No.: US 6,969,320 B2
(45) Date of Patent: Nov. 29, 2005

(54) DISTRIBUTED ACCOUNT BASED GAMING SYSTEM

(75) Inventors: Clifton Lind, Austin, TX (US); Joseph R. Enzminger, Austin, TX (US); Jefferson C. Lind, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 206 days.

(21) Appl. No.: 10/044,478

(22) Filed: Jan. 10, 2002

(65) Prior Publication Data

US 2002/0132666 A1 Sep. 19, 2002

Related U.S. Application Data

(60) Provisional application No. 60/260,780, filed on Jan. 10, 2001.

(51) Int. Cl.[7] ..... A63F 9/22
(52) U.S. Cl. ..... 463/25
(58) Field of Search ..... 463/1, 9–13, 16–20, 463/25–26, 29–30, 36, 40–43; 273/292–293, 273/236–237, 273, 309, 143 R, 139, 138.1, 273/138.2

(56) References Cited

U.S. PATENT DOCUMENTS

| | | | |
|---|---|---|---|
| 5,038,022 | A | 8/1991 | Lucero |
| 5,179,517 | A | 1/1993 | Sarbin et al. |
| 5,265,874 | A | 11/1993 | Dickinson et al. |
| 5,321,241 | A | 6/1994 | Craine |
| 5,324,035 | A | 6/1994 | Morris et al. |
| 5,326,104 | A | 7/1994 | Pease et al. |
| 5,332,076 | A | 7/1994 | Ziegert |
| 5,342,049 | A | 8/1994 | Wichinsky et al. |

(Continued)

OTHER PUBLICATIONS

Appendix X to the State of Washington Class III Gaming Compact, Rules Governing Tribal Lottery Systems, State of Washington (Nov. 13, 1998), 59 pages.

(Continued)

*Primary Examiner*—Mark Sager
(74) *Attorney, Agent, or Firm*—Russell D. Culbertson; The Culbertson Group, P.C.

(57) ABSTRACT

A back office system is preferably located in a secure area and includes one or more central computers. Each central computer stores a number of game records with each game record representing a play in a game. A database computer included in the back office system maintains an account for each authorized player in the gaming system. A casino floor system is operatively connected for communication with the back office system and includes a number of player terminals through which players may participate in various games offered in the gaming system. Each player terminal in the casino floor system is serviced by one central computer in the back office system. Each player terminal allows a player to log in and make a request for a game play, and then communicates the entered game play request to the respective central computer servicing that particular player terminal. In response to the game play request from the player terminal, the central computer system reads a selected game record from the group of game records stored in the back office system and identifies the result associated with the game record. The central computer also directs the database computer to change the player's account balance according to the game play request and result of the selected game record. The central computer also sends information regarding the game play result back to the player terminal, which then uses the information to notify the player of the result.

14 Claims, 7 Drawing Sheets

U.S. PATENT DOCUMENTS 5,371,345 A 12/1994 LeStrange et al.
5,429,361 A 7/1995 Raven et al.
5,437,451 A 8/1995 Fulton
5,451,756 A 9/1995 Holzer et al.
5,470,079 A 11/1995 LeStrange et al.
5,525,417 A 6/1996 Eyler
5,559,312 A 9/1996 Lucero
5,586,937 A 12/1996 Menashe
5,755,621 A 5/1998 Marks et al.
5,761,647 A 6/1998 Boushy
5,787,156 A 7/1998 Katz
5,811,772 A 9/1998 Lucero
5,824,611 A 10/1998 Eyler
5,833,540 A 11/1998 Miodunski et al.
5,851,149 A 12/1998 Xidos et al.
5,857,911 A 1/1999 Fioretti
5,871,398 A 2/1999 Schneier et al.
5,902,983 A 5/1999 Crevelt et al.
5,917,893 A 6/1999 Katz
5,952,640 A 9/1999 Lucero
5,954,583 A 9/1999 Green
5,959,277 A 9/1999 Lucero
5,984,779 A 11/1999 Bridgeman et al.
6,001,016 A * 12/1999 Walker et al. ..... 463/42
6,012,832 A 1/2000 Saunders et al.
6,019,283 A 2/2000 Lucero
6,024,640 A 2/2000 Walker et al.
6,035,021 A 3/2000 Katz
6,044,135 A 3/2000 Katz
6,071,190 A 6/2000 Weiss et al.
6,089,982 A 7/2000 Holch et al.
6,117,011 A 9/2000 Lvov
6,117,013 A 9/2000 Eiba
6,126,542 A 10/2000 Fier
6,128,550 A 10/2000 Heidel et al.
6,142,368 A 11/2000 Mullins et al.
6,142,873 A 11/2000 Weiss et al.
6,152,822 A 11/2000 Herbert
6,162,122 A 12/2000 Acres et al.
6,183,362 B1 2/2001 Boushy
6,227,972 B1 5/2001 Walker et al.
6,231,445 B1 5/2001 Acres
6,244,958 B1 6/2001 Acres
6,247,643 B1 6/2001 Lucero
6,254,483 B1 7/2001 Acres
6,257,981 B1 7/2001 Acres et al.
6,264,557 B1 7/2001 Schneier et al.
6,273,820 B1 8/2001 Haste, III
6,280,326 B1 8/2001 Saunders
6,280,328 B1 8/2001 Holch et al.
6,289,261 B1 9/2001 Heidel et al.
6,293,867 B1 9/2001 Heidel et al.
6,332,099 B1 12/2001 Heidel et al.
6,340,331 B1 1/2002 Saunders et al.
6,347,738 B1 2/2002 Crevelt et al.

OTHER PUBLICATIONS

Washington State Gambling Commission, Multimedia Games IVLS 2000, Tribal Lottery System Certification of Compliance (Jun. 1999); 8 pages.

* cited by examiner

DISTRIBUTED ACCOUNT BASED GAMING SYSTEM

CROSS-REFERENCE TO RELATED APPLICATION

This application is related to U.S. provisional patent application Ser. No. 60/260,780, filed Jan. 10, 2001 and entitled "Distributed Account Based Gaming System." The Applicants hereby claim the benefit of this provisional patent application under 35 U.S.C. §119(e). The entire content of this application is incorporated herein by this reference.

TECHNICAL FIELD OF THE INVENTION

This invention relates to systems that enable a player to participate in games of chance. More particularly, the invention relates to a gaming system utilizing player accounts maintained at a back office portion of the gaming system for tracking player activities, including wagers and winnings. The invention encompasses a method, system, and program product.

BACKGROUND OF THE INVENTION

Traditional gaming systems employ coin or token operated gaming devices. In these traditional gaming devices a player inserts one or more coins or tokens as a wager in the game. This activates the gaming device to allow the player to make a play. The player next makes some input at the gaming device and the device ultimately responds by displaying the result of the play. In a reel-type gaming machine or slot machine, for example, the player pulls a handle to cause actual or electronically represented wheels to spin, and then eventually stop in an ending position. The ending positions of the reels determine whether the play wins a prize or does not. Regardless of the type of game being played, whether a mechanical or electronic reel-type game, an electronic card game, or some other electronic casino game, the traditional gaming devices themselves determine whether or not the play is a winning play.

More recent gaming systems allow players to fund an account specific to the player and then make wagers from the account. These types of systems are commonly referred to as "cashless" systems. Cashless systems are advantageous in that the player need not carry cash or tokens in order to participate in a game. Rather, once the player has funded his or her account, they may identify the account at a gaming device and then make wagers using funds recorded in their account. Account information for the player is maintained in a data-processing device in communication with the gaming devices. This data processing device deducts wagers from the account and adds winnings. However, the data-processing device that maintains the player account relies on information from the gaming devices to determine when the player account should be debited and credited.

SUMMARY OF THE INVENTION

The present invention utilizes a back office system and a casino floor system. The back office system is preferably located in a secure area and includes one or more central computers. Each central computer stores a number of game records, that is, more than one game record. Each game record represents a play in a game and is associated with a result which may be a winning result having some associated prize value. According to the present invention, a database computer included in the back office system maintains an account for each authorized player in the gaming system. The account for a particular player is maintained in one or more database entries stored at the database computer and includes an account balance from which wagers are deducted and to which winnings are added.

The casino floor system is operatively connected for communications with the back office system and includes a number of player terminals through which players may participate in various games offered in the gaming system. Each player terminal in the casino floor system is serviced by one central computer in the back office system. Each player terminal allows a player to log in and make a request for a game play, and then communicates the entered game play request to the respective central computer servicing that particular player terminal. In response to the game play request from the player terminal, the central computer system reads a selected game record from the group of game records stored in the back office system and determines or identifies the result associated with the game record. The central computer also directs the database computer to change the player's account balance by deducting the amount of the wager associated with the play request and by adding the amount of any winnings associated with the game record result. The central computer also sends information regarding the result associated with the game record back to the player terminal. The player terminal then uses this information to display the result, or some representation consistent with the result, in order to notify the player of the result.

The method according to the invention is performed by computer program code and includes storing game records in the back office system and maintaining an account in the back office system for each of a number of players, each account including an account balance and preferably an account identifier. The method also includes reading a selected game record in response to a game play request from a player terminal to determine or identify the result of the game record. This reading step is also performed in the back office system, preferably by the respective central computer assigned to the respective player terminal. The method further includes subtracting the wager amount from the player's account and crediting any winnings associated with the game record result. This account modification step is also performed entirely in the back office system. Finally, the method includes notifying the player of the result of the selected game record. This notification step preferably includes making a display at the player terminal from which the play request was submitted. The display includes the result or some representation indicating the result.

The present invention does not determine the results of a game play at the player terminals. Rather, the results of each game play are determined by reading the result information from the game play records at the secure back office system location. Thus, the system provides enhanced security in a cashless gaming environment. Also, utilizing multiple central computers dedicated to different groups of player terminals enhances system performance and makes the gaming system more fault tolerant.

These and other advantages and features of the invention will be apparent from the following description of the preferred embodiments, considered along with the accompanying drawings.

DESCRIPTION OF THE PREFERRED EMBODIMENTS

Figure 1:
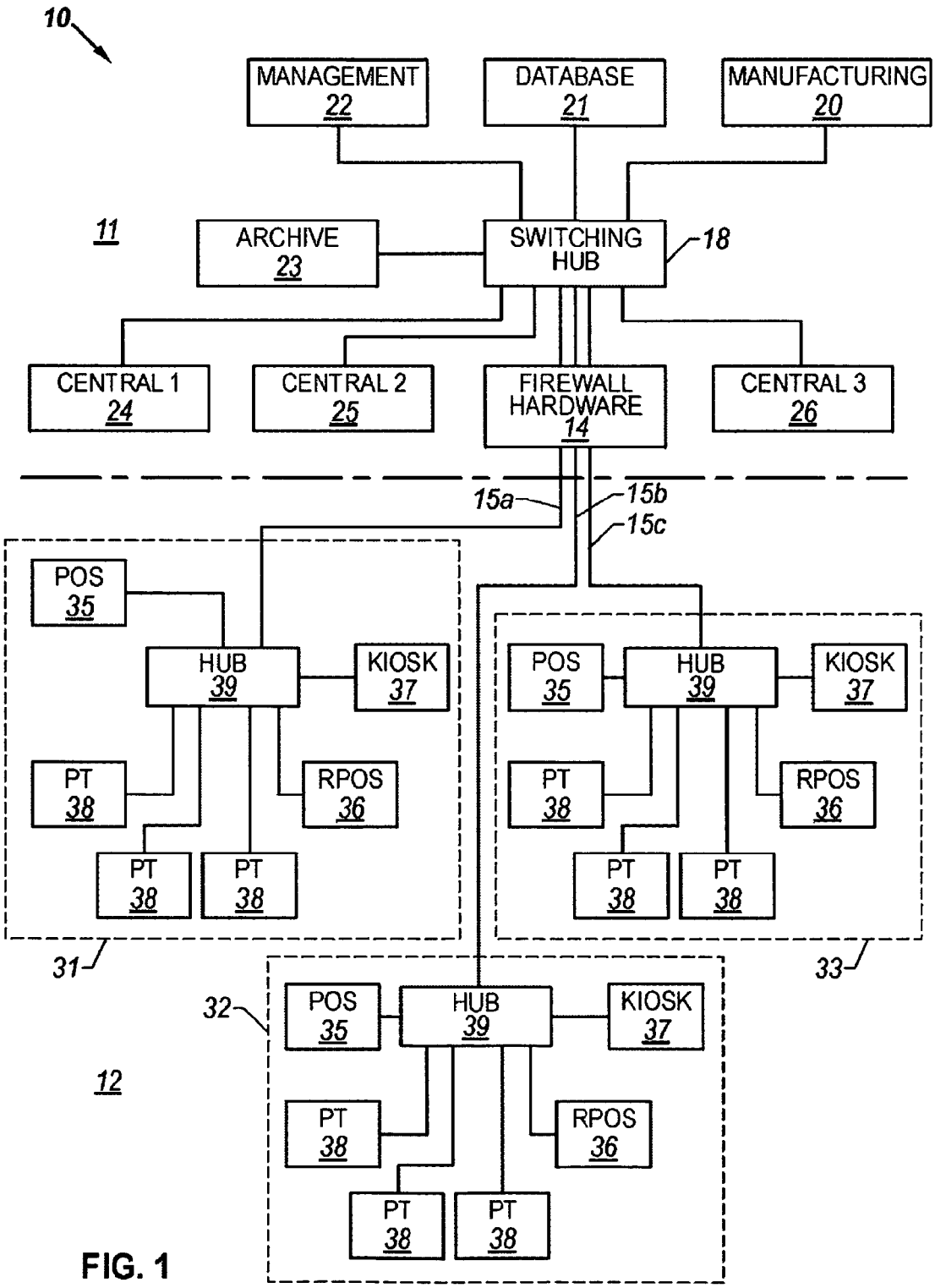
FIG. 1 is a diagrammatic representation of a gaming system embodying the principles of the invention.

Referring to FIG. 1, an account based gaming system 10 embodying the principles of the invention includes a back office system 11 located in a secure area and a casino floor system 12 accessible to the public. Casino floor system 12 allows players to establish and modify accounts in gaming system 10, and allows players to participate in various games available through the gaming system. Back office system 11 maintains accounts and account balances for all players, maintains account information, and provides system usage reports and other reports useful in managing gaming system 10. Back office system 11 also preferably creates game sets made up of a number of predetermined game records and selects game records in response to player requests made through front office system 12.

A secure communications arrangement is used to facilitate communications between back office system 11 and casino floor system 12. Security may be enhanced with hardware firewalls 14 connected in the communications lines 15*a*, 15*b*, and 15*c* which extend to casino floor system 12 and/or by firewall software operating on the various computers that make up back office system 11.

Back office system 11 includes a number of separate processing devices interconnected through a suitable communications arrangement. In the illustrated form of the system, back office system 11 includes a switching hub 18 to which each separate processing device connects. The three floor system communication lines 15*a*, 15*b*, and 15*c* also connect into switching hub 18. Although other types of computer network communications hubs may be used within the scope of the invention, a switching hub is preferred to allow the various system components to communicate simultaneously with fewer conflicts and thus increased overall system performance.

Figure 2:
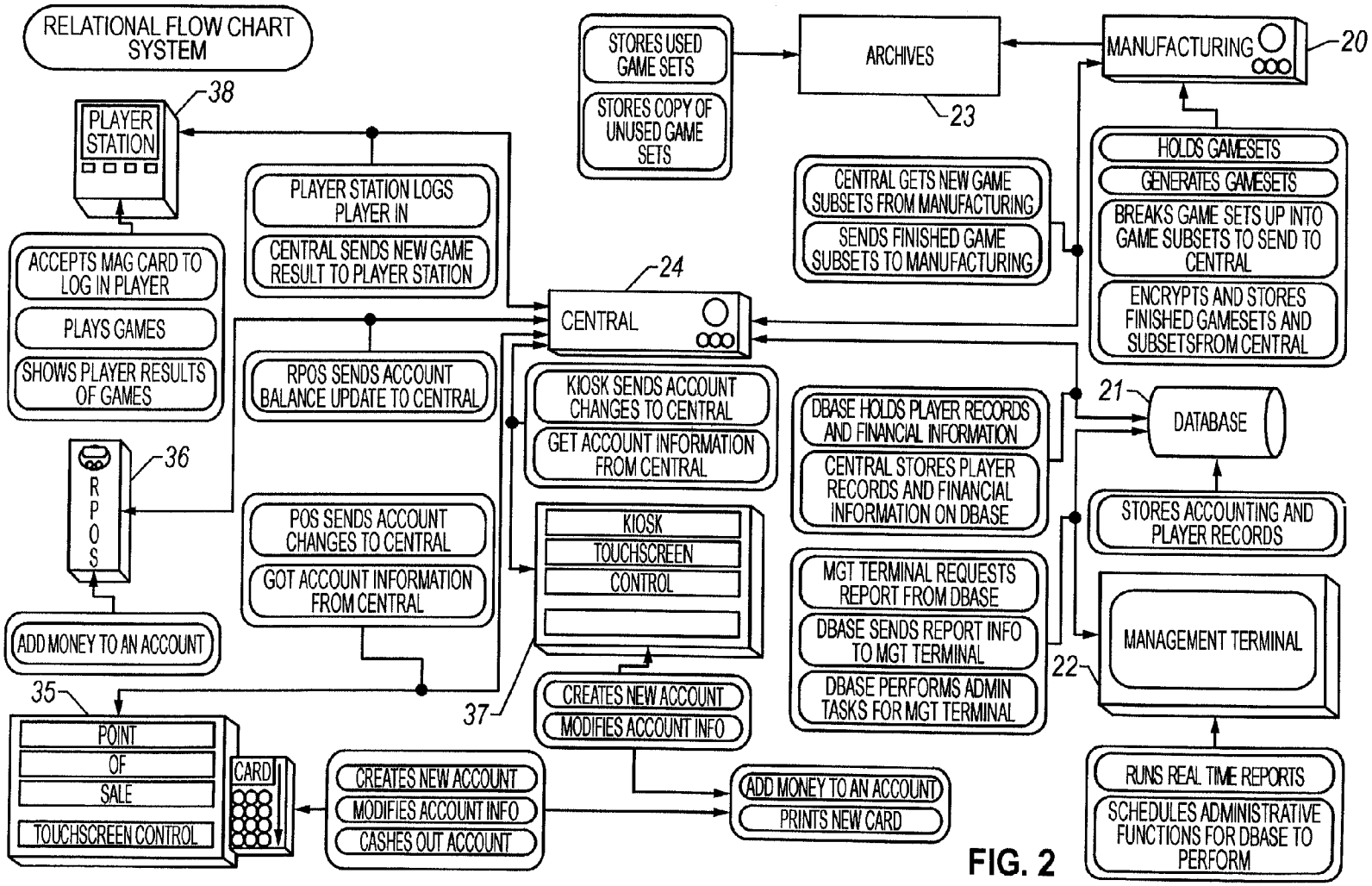
FIG. 2 is a relational flow chart showing the various components of the present gaming system and the processes performed by the various components.

The illustrated preferred form of the invention shown in FIG. 1 includes a manufacturing computer 20, a database computer 21, a management interface computer 22, an archive computer 23, and three separate central computers 24, 25, and 26. As indicated in FIG. 2, manufacturing computer 20 manufactures game sets, divides the game sets into a number of subsets and stores the unused subsets until requested by one of the central computers 24, 25, or 26. Manufacturing computer also receives used subsets back from the various central computers and once all of the subsets are used, stores the used game set at archive computer 23. The structure of the game sets and subsets as well as the structure of individual game records in the subsets will be discussed further below.

Each central computer 24, 25, and 26 is programmed to communicate with a different subset of casino floor devices. FIG. 1 shows three subsets of casino floor devices for purposes of example, subsets 31, 32, and 33. For the purposes of this disclosure it may be assumed that central computer 24 cooperates with casino floor subset 31, central computer 25 cooperates with casino floor subset 32, and central computer 26 cooperates with casino floor subset 33. Each subset of casino floor devices in the illustrated form of the invention includes a point-of-sale (POS) terminal 35, a remote point-of-sale (RPOS) terminal 36, a kiosk 37, and a number of player terminals 38. The devices in the respective subset are connected to a local communications hub 39, which is connected to one of the network links 15*a*, 15*b*, or 15*c*. These casino floor devices will be described in further detail below.

Referring to both FIGS. 1 and 2, each central computer 24, 25, and 26 independently requests subsets of the game records from manufacturing computer 20 and preferably receives two game subsets a time. Each central computer 24, 25, and 26 also preferably stores backup game records subsets as will be discussed further below with reference to FIG. 7. The respective central computer stores the game record subsets it receives for use by the player terminals 38. Each central computer 24, 25, and 26 also receives player-related information from the various casino floor devices in the respective subset of devices, and stores this player-related information in database computer 21. For example, central computer 24 may receive a request from POS device 35 in subset 31 to add money to a player's account, withdraw cash from the player's account, and add or modify other player information such as a player's name, personal identification number (PIN), game usage information, and perhaps other player-related information. As a further example, central computer 24 may receive a request from any one of the player terminals 38 in subset 31 for a game record and an amount of wager associated with the request. Central computer 24 may then add winnings to the player's account based on results of the game record retrieved from a particular game record subset in response to the game record or game play request.

The multiple central computer arrangement shown in FIG. 1 provides several advantages. First, in the event that a single central computer experiences a technical problem which interferes or prevents its operation, only a single subset of casino floor devices is affected. Second, the multiple central computer arrangement shown in FIG. 1 is readily scalable to increase or decrease the number of casino floor devices supported by the system. Furthermore, the multiple central computer arrangement facilitates faster communications with the casino floor devices and therefore increases the speed at which a player may play games offered through the gaming system 10.

As indicated in FIG. 2, database computer 21 serves as a data storage repository for holding all player records and player account information. Database computer 21 operates under the control of database software to store in its associated memory at least one database containing a player entry for each player authorized to play games available through system 10. Each player database entry includes information on the respective player such as the player's name, the player's identification or account identifier or number, the player's PIN when used in the system, the player's account balance, and perhaps other player information personal to the particular player. The database entry for a particular player may also include usage information indicating which casino floor devices the player has used, the times the devices have been used, and the extent of use.

Numerous different database structures will be apparent to those of skill in database development and use. The invention encompasses any suitable database structure for maintaining the player and other information required in the operation of the gaming system 10. In particular, the various data associated with a player may be distributed across entries in a number of tables making up the database. Also, the required information may be stored in multiple databases. Furthermore, the information stored in the database or databases may vary depending upon specific options used in a particular implementation of the present system. For example, the preferred form of the system requires that a player enter a PIN when their account is created. The PIN is then required in order to have any access to the player's account through the various player actuated casino floor devices, subject to management intervention in the event a player forgets their PIN. In this preferred form of the invention, the database information for each player includes the player's PIN. However, the system may be implemented so that a PIN is not required. In this case, of course, the database information for each player will not include a PIN.

Management computer 22 comprises a separate computer system which operates under the control of management terminal software. This management terminal software provides system reports including real-time reports and system usage and performance reports of interest to the system operators, managers, and regulators. The software executed at the management computer 22 also may be used to schedule administrative functions required or helpful for the database computer system 21. Management computer 22 preferably includes a suitable display for displaying reports and other information and providing a user interface. Although not shown in FIG. 1, a printer may be included in system 10 for printing reports and other materials. Of course, any such printer need not be connected directly to management computer 22 but may be accessible through the computer network making up back office system 11.

Archive computer 23 serves as a repository for used game sets. Manufacturing computer 20 transfers used game sets to archive computer 23 upon completion of the game sets. These used game sets may be archived or stored in any suitable fashion in a non-volatile storage device associated with archive computer 23. Archive computer 23 also preferably stores a copy of each unused game set. The copy of the unused game set may be transferred to archive computer 23 at any time after the game set is created, and is preferably transferred together with the corresponding used game set.

The casino floor devices shown in FIG. 1, may be described with reference to a single subset 31 of such devices. The other subsets 32 and 33 shown in FIG. 1 include the same types of devices as subset 31 and need not be described separately. However, it should be noted that the subsets 31, 32, and 33 of casino floor devices need not be identical. Rather, the various subsets of casino floor devices may include different numbers of casino floor devices and different types of casino floor devices.

Referring particularly to subset 31, each player terminal 38 comprises a computer system having a display, a player card reader, and controls by which the player may enter commands such as play requests and other commands related to the play of a game available through the player terminal. Any suitable display and player interface may be used within the scope of the invention. For example, the display may be a touch sensitive screen or a nontouch sensitive screen which provides a graphical user interface (GUI). Switches or other controls may be included in the player terminal 38 in addition to or in lieu of the GUI. Player terminal software executed by the computer system making up player terminal 38 controls the operation of the respective terminal. As indicated in FIG. 2, each player terminal 38 receives information from the card reader to log a player in to the respective central computer (24), allows a player to play games, and shows a player the results of a game play or record obtained from the respective central computer. Further details of player terminal operation will be described with reference to FIGS. 3 and 4.

FIG. 2 shows that each POS or cashier terminal 35 provides a player interface to gaming system 10 for allowing a player to create an account in the system, cash out their account, and make changes to their account information stored at database computer 21 such as adding/withdrawing funds or changing a PIN of other account information. As with all other casino floor devices, account related activity affecting information at database computer 21 is controlled through the respective central computer communicating with the particular POS.

Each POS terminal 35 is implemented through a computer system having a suitable data processing device. Each POS terminal 35 also includes a player interface and a cashier/attendant interface, or a shared player/attendant interface. The preferred POS terminal 35 includes a touch screen display, a player card encoder/printer, a card reader, and a cash drawer accessible to the attendant. A keyboard or keypad may be required for player/attendant entries in the event the display is not a touch screen display. The POS terminal 35 executes software which allows the player and attendant to perform all of the functions allowed at the terminal as will be described in further detail below with reference to FIG. 5.

RPOS terminals 36 and kiosks 37 each provide a subset of the functionality of the POS terminals 35 and are preferably included in the system 10 to give the players more choices in how they may modify their account information. In the preferred form of the invention, RPOS terminal 36 allows a player to add funds to their player account maintained by back office system 11 as indicated in FIG. 2. Each RPOS terminal 36 is implemented through a computer system and includes a suitable processing device and a user interface including a display. The preferred user interface also includes a player card reader, a keyboard/keypad, and a bill/coin acceptor. Each RPOS terminal 36 operates under the control of RPOS terminal software instructions to provide all of the RPOS functionality as will be described below with reference to FIG. 5.

Each kiosk 37 also preferably comprises an unattended and automated computer-based system. As indicated in FIG. 2, a player may use a kiosk 37 to open a new account, add funds to their account maintained via back office system 11, and modify certain account information such as the player's PIN or name. Each kiosk 37 includes a suitable data processing device, a touch sensitive display, a player card reader, a player card encoder/printer, and a bill/coin acceptor. A keyboard or keypad may be required if the display is not a touch sensitive type. Also, each kiosk operates under the control of operational software code as will be described below with reference to FIG. 6.

BASIC OPERATION OF THE GAMING SYSTEM

Once a player has opened an account with gaming system 10, has received their player card (magnetic strip or other data carrier card), and has set their PIN in the system (if a PIN is used), the player may log in to the system at any player terminal 38 and make a game play request. The player information including an account identifier uniquely identifying the particular account, a PIN, and account balance are stored in back office system 11 and specifically in a data storage device associated with database computer 21. The player's name is not required according to the invention but is also preferably stored at database computer 21 with the other player information. A player logs in at a player terminal 38 by inserting their player card into the card reader associated with the game terminal. The player terminal then communicates information from the player card and particularly the player/account identifier to the respective central computer servicing the particular player terminal. Assume for purposes of example that central computer 24 services the particular player terminal 38. After logging in at player terminal 38, the player may then attempt to play a game at the player terminal by entering a play request through the user interface at the player terminal. In response to the game play request entered at player terminal 38, the terminal transmits the request to central computer 24. The game play request amounts to a request to modify the player's account by reducing account balance by the amount of the wager indicated in the game play request and increasing the player's account with any winnings associated with the game record the player receives. If the player has sufficient funds in their account to cover the wager indicated in the game play request, central computer 24 retrieves the game record from the appropriate subset of game records stored at the central computer, modifies the player's account according to the amount of wager and any winnings dictated by the retrieved game record, and sends a result index for the retrieved the game record along with the new account balance and the player's identifier back to the player terminal. The amount of the prize associated with the retrieved game record may also be included in the information returned to player terminal 38. Player terminal 38 responds to this communication from central computer 24 by producing a display consistent with the received result index and preferably by displaying any amount won and the player's new account balance. Further details of the game records and game sets and subsets will be described with reference to FIG. 7.

Figure 3:
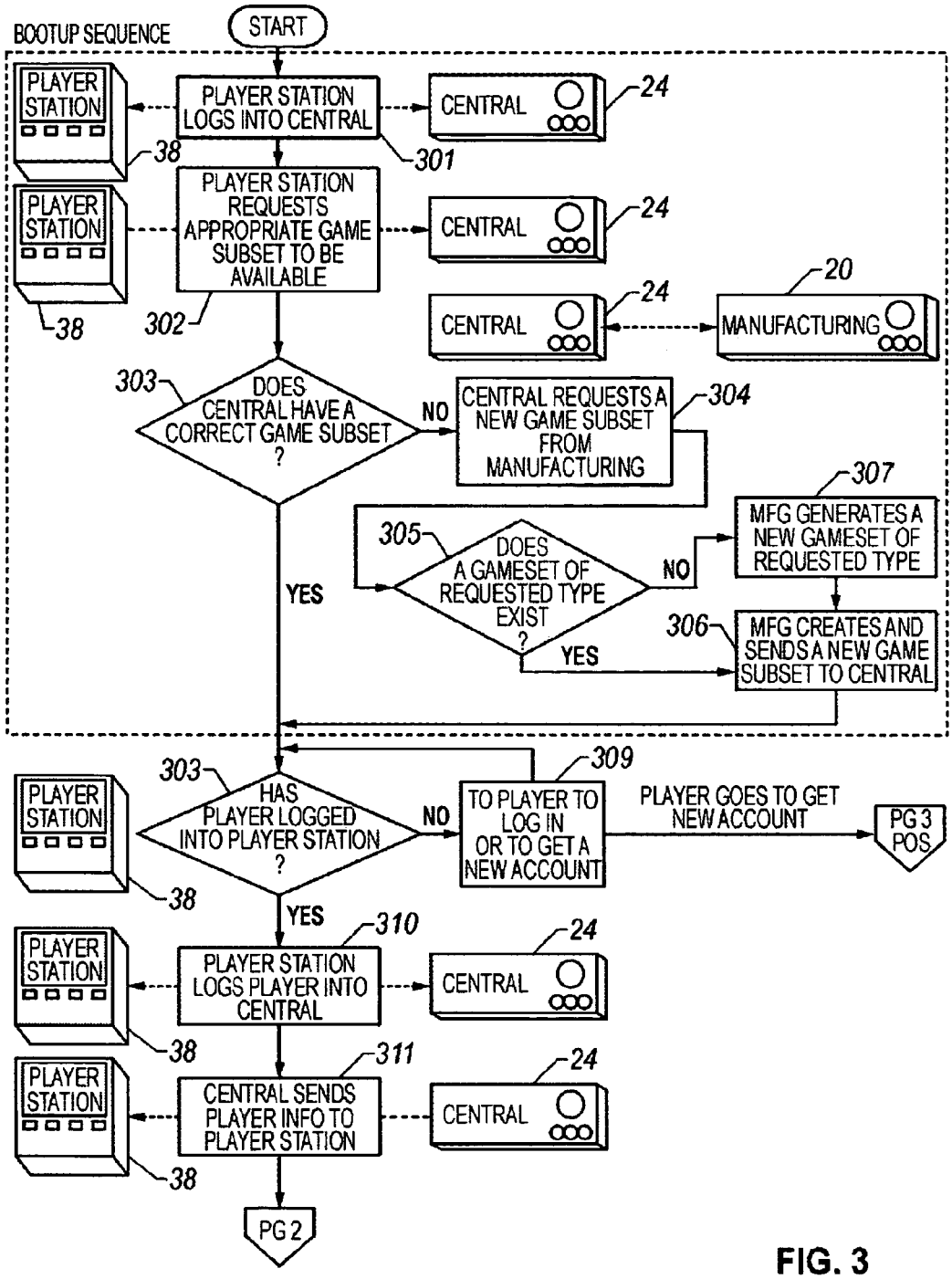
FIG. 3 is a flow chart showing an initialization process between the player terminals and central computer, and a player log in procedure at the player terminal.

Further operational details of the various system components will be described with reference to FIGS. 3 through 6. Referring particularly to FIG. 3, the system is initialized or booted with player terminal 38 first logging into the respective central computer 24. This login may be accomplished in a number of different fashions within the ordinary skill of the art of computer network communications. Generally, player terminal login may include a "handshaking" procedure 301 in which the respective player terminal communicates network identifying information to the respective central computer and the central computer acknowledges the login communication with a suitable response. At 302, player terminal 38 communicates a terminal identifier to the central computer. Central computer 24 understands this terminal identifier as a request that a particular type of game subset be available in the central computer. Step 302 is required since player terminal 38 may be used to play any of a number of games, not all of which use the same subset of game records.

In response to the request for the appropriate game subset at step 302, central computer 24 checks its data storage to determine if it is currently storing the correct game record subset or subsets as indicated at decision block 303. If not, central computer 24 requests that an appropriate new game record subset (or subsets as discussed with reference to FIG. 8 below) be transmitted from the manufacturing computer at step 304. Manufacturing computer 20 then determines whether a game set of the requested type exists in the manufacturing computer storage as indicated at decision block 305. If the appropriate game set does exist, manufacturing computer 20 sends a new game record subset to the requesting central computer 24 as shown at 306. If manufacturing computer 20 determines that it does not contain the required game set, however, the manufacturing computer invokes its game set generation program code to generate a new game set of the requested type as indicated at block 307. Once the new game set is available, manufacturing computer 20 creates the game record subsets and then sends a game record subset to the central computer at step 306. It may be possible for the situation to occur in which manufacturing computer 20 is unable to produce a new game set. In this case, manufacturing computer responds that it cannot produce the new game set needed. This communication has the effect of making unavailable the game or games at the requesting player terminal 38 which use records from that game set.

Once the initializing sequence is complete, the process at player station terminal 38 proceeds to decision box 308 to determine if a player has logged in to the player terminal. If no player has logged in to player terminal 38, the terminal preferably produces an attract display as indicated at block 309 which encourages a potential player to log in and perhaps provides additional information such as how and where to open a player account. Player terminal 38 may also display a representation of a game play to entice a potential player to log in and play the game available at the terminal. If a player has logged in at player terminal 38 (by inserting the player card into the terminal's card reader for example), the player terminal logs the player in to central computer 24 as indicated at block 310. This log in step preferably includes communicating the player identifying information (account identifier) to the central computer. As indicated at 311, central computer 24 uses the player's account identifier to obtain player information for the identified player/account from the database computer 21, and sends certain player information to the player terminal. This returned information may include the player's name in order to allow the player terminal to issue a greeting to the player, and preferably also includes the player's account balance to be displayed at the player terminal.

Figure 4:
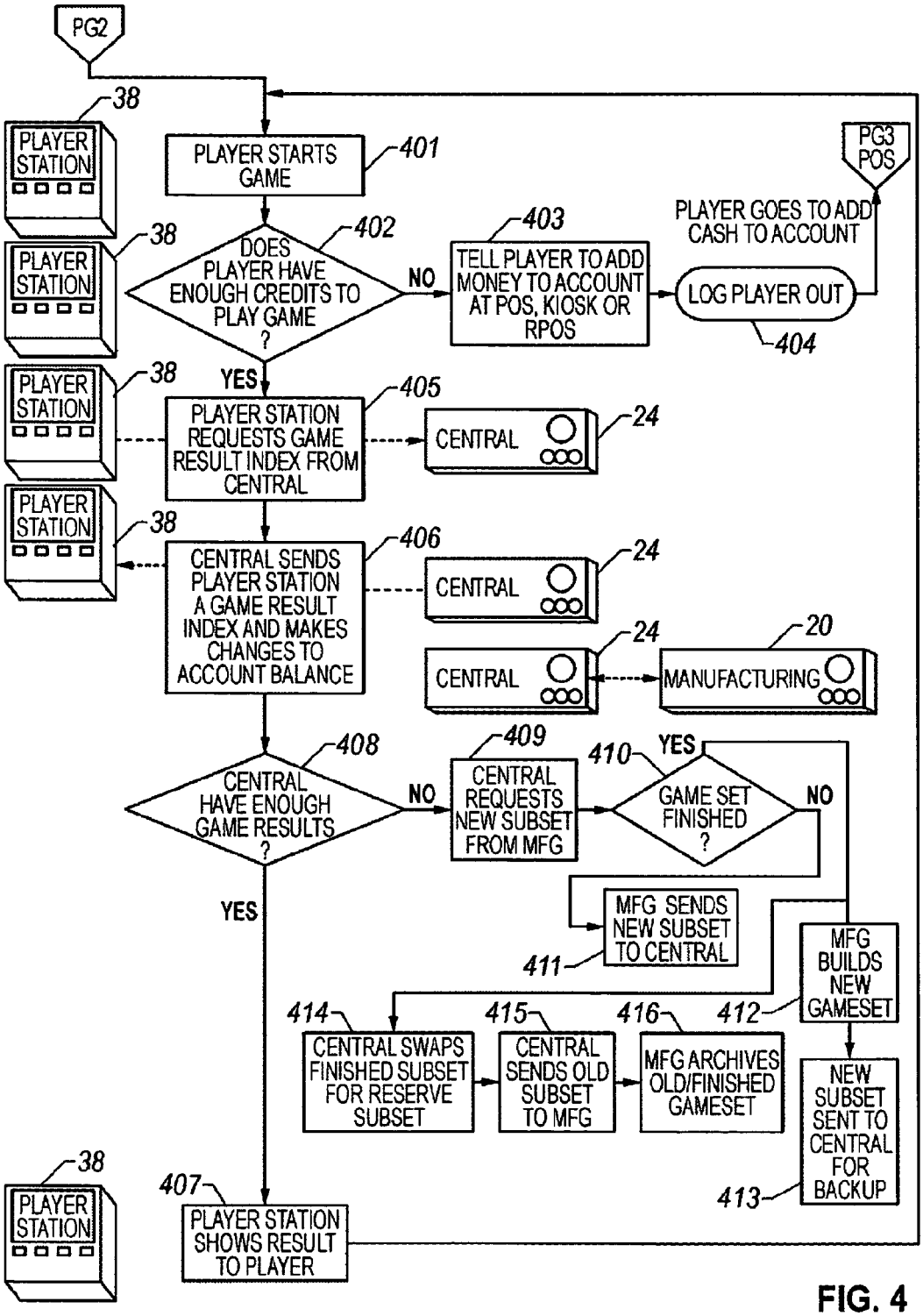
FIG. 4 is a flow chart showing the interactions between a player terminal, central computer and the manufacturing computer during the course of game play.

Referring now to FIG. 4, once the player is logged in to central computer 24, the player may begin play as indicated at process block 401 by making a game play request using the various controls or user interface at player terminal 38. Operational software at player terminal 38 determines if the player has enough credits to make the requested play as indicated a decision block 402 and, if not, generates a notice as indicated at process block 403 to notify the player to add more funds to their account. Player terminal 38 then the logs the player out of central computer 24 as shown at 404. If the player does have sufficient credits to make the requested wager or play as determined at decision block 402, player terminal 38 transmits a game play request to central computer 24 as indicated at block 405. This game play request represents to central computer 24 a request to reduce the player's account by the amount of the wager, a request for a game record, and a request to add the amount of any winnings associated with the retrieved game record to the player's account balance. Central computer 24 then retrieves a game record from the appropriate game subset which is active at the central computer, reads the result, makes the indicated account balance changes in the account balance at database computer 21, and communicates a result index read from the game record back to player terminal 38. These steps are shown at process block 406 in FIG. 4. As indicated at block 407, operational software executed by player terminal 38 responds to the result index by creating a display which displays the result of the game play in some suitable fashion. The new account balance and winning amount may also be communicated to player terminal 38 along with the result index, and both values may be displayed to the player at the player terminal.

In response to each game play request from one of the player terminals 38 serviced by central computer 24, the central computer checks to see if it has enough unused game records left for the particular type of game. This step is shown at decision block 408 in FIG. 4. If insufficient game records are available in the indicated subset, central computer 24 requests a new subset of game records for that particular game from manufacturing computer 20 as indicated at block 409. If the game set from which the completed subset was made is not finished or completely used up as indicated at process block 410, manufacturing computer 20 sends a new game record subset to central computer 24 as shown at block 411. However, if the result of the inquiry at decision block 410 indicates that the game set is finished, manufacturing computer 20 builds a new game set if possible as shown at process block 412. When the new game set and new subsets are available at manufacturing computer 20, the manufacturing computer sends central computer 24 a new game record subset to use as a backup. This step is shown at process block 413 in FIG. 4.

Also, if the game set is finished or totally used as determined at block 410, central computer 24 swaps the used game record subset for the current reserve or backup subset stored at the central computer. This subset swapping step is shown at step 414 in FIG. 4. Central computer 24 then sends the used subset back to manufacturing computer 20 as shown at block 415. Manufacturing computer 20 archives the finished or used game set at archive computer 23 as indicated at block 416.

The transfer of game record subsets to the central computers is performed so as to ensure game records are quickly available at the central computer to service any game play request. It may also be desirable to include additional features to ensure that a game may not be commenced at a player terminal unless the central computer may completely service the request. According to one form of gaming system 10, the central computers monitor each game subset that they store. If a predetermined minimum number of game records is reached in a game record subset without a reserve or backup subset being ready, the central computer may lock out the game that uses the particular record subset. This lockout is preferably accomplished by communicating a suitable game lockout message to each player terminal programmed with that particular game. The player terminal 38 responds to the lockout message by making the particular game unavailable to a player who may log in at the terminal. Alternatively, the player terminal 38 may simply not allow a player to log in at the terminal by not responding to an inserted player card and producing a display showing that the terminal is not available.

Figure 5:
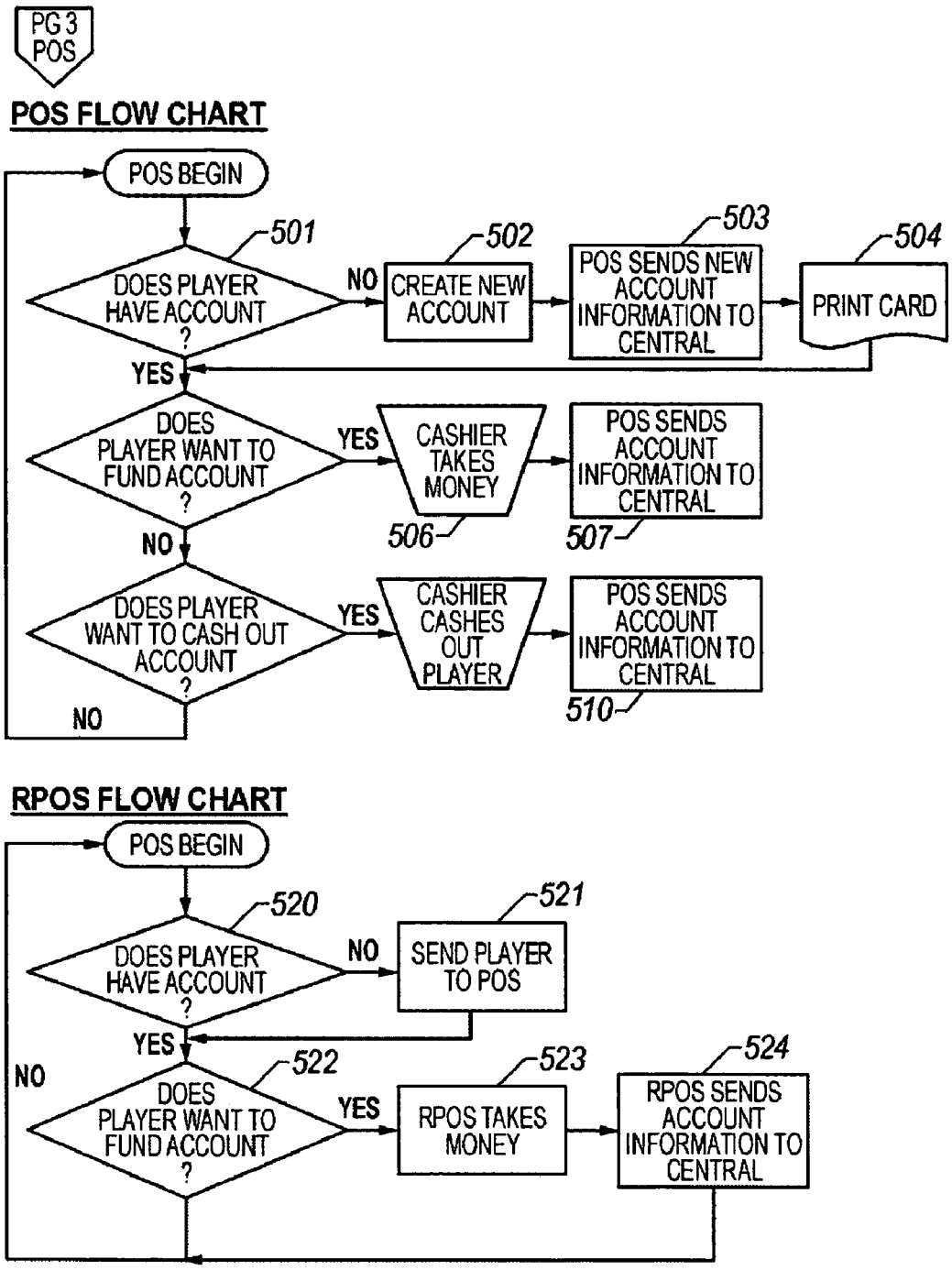
FIG. 5 comprises flow charts showing the process at a POS terminal and the process at a RPOS terminal.

FIG. 5 shows the general process performed at POS terminal 35 and the general process performed at RPOS 36. At the beginning of the POS process, the attendant at POS terminal 35 determines whether the player has an existing account with the system. This determination step is shown at decision block 501 in FIG. 5. If the prospective player does not have an account, the POS attendant prompts the POS terminal to create a new account as shown at block 502. Creating a new account involves inputting player information such as the player's name, and perhaps a PIN selected by the player (if PINs are used in the system). This information is communicated to central computer 24 as indicated at process block 503 and the central computer responds to the new account request and information by assigning an account identifier to the new account and storing the account identifier and the player information at database computer 21. More specifically, central computer 24 requests that the database computer store the information and the database computer complies. Central computer 24 also communicates the account identifier back to POS terminal 35 and the POS terminal prints or encodes the identifier on a player card for the player as shown at 504, and then issues the player card to the player. This player card preferably comprises the magstripe card with the players account number recorded on the magnetic stripe.

If the player wants to add funds to their account, the POS terminal attendant takes the deposited funds as shown at 506 and enters the amount being added using a suitable interface at the POS terminal. Alternatively, to manually entering the funded amount a bill acceptor at the POS terminal may determine the amount being added. In any event, POS terminal 35 communicates the amount to be added to the player's account to central computer 24 as shown at step 507. Central computer 24 then causes the player's account balance stored at database computer 21 to be updated by adding the entered amount to the earlier balance for that player and storing the new balance at the database computer.

If the player wishes to cash out their account, the POS terminal attendant causes the POS terminal to send a cash out request to central computer 24 as shown at step 510. As with all communications associated with a particular player's account, the request includes the player's account identifier (and the player's PIN where PINs are used). Central computer 24 responds to the cash out request by retrieving information on the player's account balance from database computer 21 and communicating the cash balance back to POS terminal 35. Once the account balance has been communicated back to POS terminal 35, the POS terminal attendant may pay the player the indicated cash amount. Of course central computer 24 also causes the account balance at database computer 21 to be adjusted to zero.

Referring still to FIG. 5 the process that RPOS terminal 36 allows a player to add additional funds to the player's account created through POS terminal 35 or kiosk 37. The first step in the RPOS process is determining whether the player has an account as shown at decision block 520. In the preferred RPOS implementation, RPOS terminal 36 detects that a player has inserted their player card into the RPOS card reader, the card reader reads the account identifier from the card and communicates the identifier to central computer 24 with an instruction requesting that the account be verified. If central computer 24 does not verify the account, RPOS terminal 36 preferably displays an "INVALID ACCOUNT-SEE ATTENDANT" message as shown at step 521. If RPOS terminal 36 determines that the player has a valid account, the terminal provides a display asking the player if they want to add funds to their account. If the player wants to fund their account as indicated by the response to the query represented by decision box 522, RPOS terminal 36 actuates its bill/coin acceptor to receive cash from the player as shown at step 523. Once the player has inserted the cash or coins , RPOS terminal 36 communicates a message to central computer 24 to cause the central computer to modify the player's account information at database computer 21. This communication step is shown at step 524 in FIG. 5. The message preferably includes the player's account identifier and the amount to be added to the player's account. This message represents a request that the central computer add this amount to the player's account balance stored at database computer 21. Central computer 24 responds to this request by accessing database computer 21 and causing the database computer to add the requested amount to the player's account balance.

Figure 6:
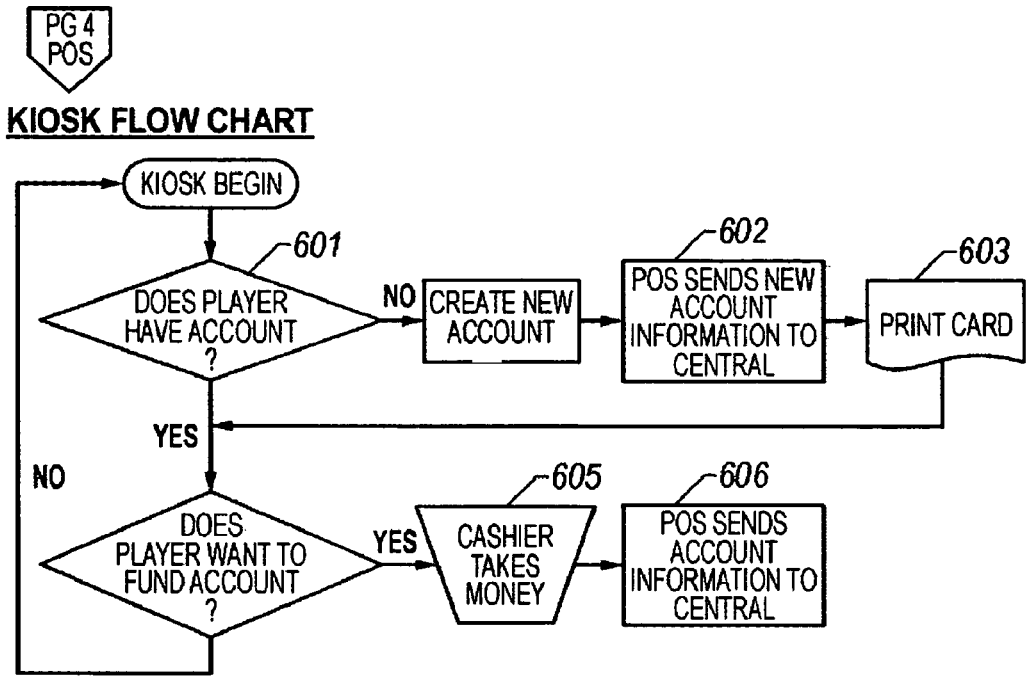
FIG. 6 is a flow chart showing the process at a kiosk.

Referring to FIG. 6, the processes performed at kiosk 37 includes determining whether the player has an account by monitoring the player card reader associated with the kiosk as shown at step 601. If the player does not have a valid account, kiosk 37 requests that a new account be created by sending an appropriate request to central computer 24 along with the necessary player information to create an account. This request and information communication step is shown at step 602 in FIG. 6. Similarly to the process described above with reference the POS terminals 35, central computer responds to the account creation request by communicating back information necessary to print/encode the player's card as shown at 603. Also, central computer 24 causes database computer 21 to create an entry for the player's account in the player information database. If the player wishes to fund their account, the kiosk attendant or a mechanical bill acceptor at the kiosk takes the player's cash as indicated at step 605 and the kiosk communicates the added funds information to central computer 24 at step 606. This step is similar to that described above with reference to the POS and RPOS terminals and blocks 510 and 524 in FIG. 5.

Figure 7:
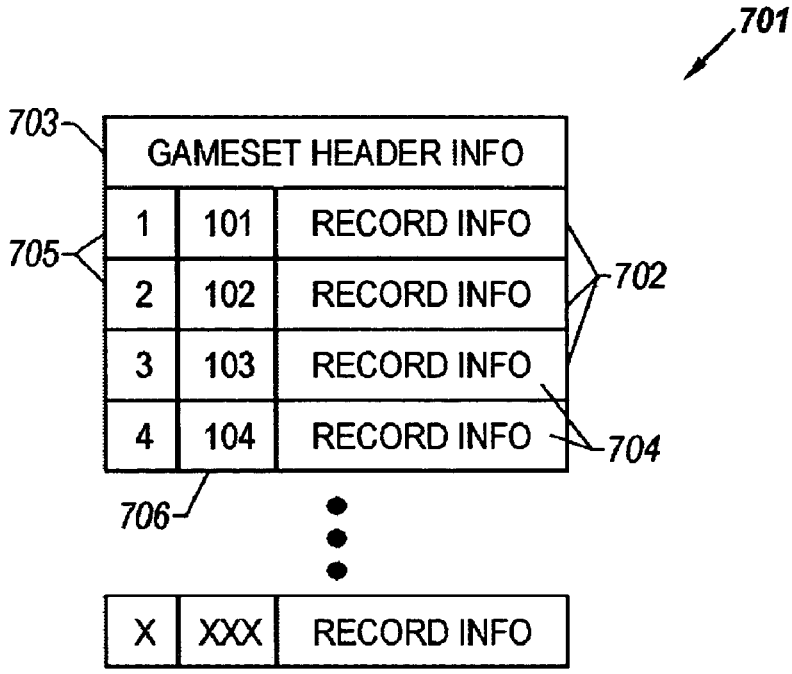
FIG. 7 is a diagrammatic representation of a game set according to the invention.

Referring to FIG. 7, each game set 701 includes a large number of game records 702. Each game record 702 represents a chance in a game available in the gaming system and may be thought of as an electronic lottery ticket. The preferred game set 701 of game records 702 includes a game set header 703 including game set identifying information such as a game serial number, game set serial number, game name, and other game set identifying information (not shown). Each separate game record 702 comprises a data structure including identifying information along with record outcome information 704. Outcome information 704 preferably comprises a code or record index that represents a certain outcome in the particular game, and may further include an outcome value. The record identifying information may include a sequence identifier 705 identifying the order of the particular record in the game set, and a record serial number 706 which uniquely identifies the respective game record. As discussed above, the game set 701 is, in the preferred form of the invention, divided into a number of subsets of game records for distribution to the various central computers 24, 25, and 26 for use in gaming system 10. These subsets comprise a data structure similar to that shown in FIG. 7, and may, for example, include 5000 game records from the game set. The only differences being that the header information identifies the data structure as a subset of a particular game set. The sequence identifier 705, record serial number 706, and record outcome information in the various game records 702 remains unchanged when the records are divided out into game record subsets from a given game set 701.

One primary purpose of the game set/subset identifying information is to identify the particular game set/subset as containing game records for a particular type of game and wager amount available through gaming system 10. In the preferred form of the invention, the player has a choice of wager amount for each game play request. Both the game and the amount of wager together identify the particular game set/subset from which a record should be retrieved in order to service the game play request. For example, a keno-type game implemented on gaming system 10 may allow a player to chose up to 8 spots on a grid and may allow a wager of anywhere from 1 to 8 credits per game play request. Such a game requires the servicing central computer to store one game record subset for each combination of wager amount and number of spots chosen in the game play, for a total of 64 game sets in the preferred form of the invention.

Figure 8:
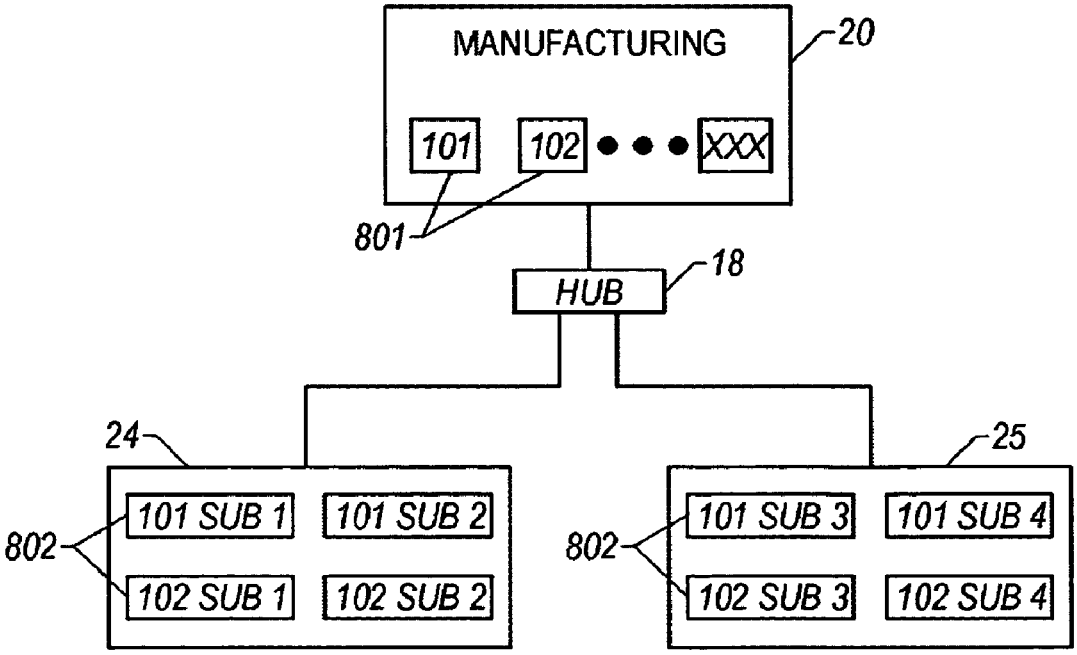
FIG. 8 is a diagrammatic representation showing the distribution of game record subsets according to the invention.

FIG. 8 illustrates the preferred manner in which game record subsets are stored on the central computers. As indicated FIG. 8, manufacturing computer 20 stores a number of game sets 801. For example, manufacturing computer 20 stores a game set identified as game set 101 and a game set identified as game set 102. Each of these game sets is divided into a series of game record subsets 802 which may be numbered consecutively subset 1, subset 2, and so forth. For enhanced security, each central computer services game play requests from two different game record subsets. As game play requests are received from player terminals 38, the central computer alternates retrieving game records from the two active subsets. The active subsets on central computer 24 shown in FIG. 8 are labeled 101sub1 and 101sub2. A first game play request will cause central computer 24 to retrieve the next available game record from 101sub1, while the next game play request will cause the central computer to retrieve a game record from 101sub2. The next retrieved game record would then come again from subset 101sub1 and so forth.

In FIG. 8 subsets 102sub1 and 102sub2 at central computer 24 represent backup or reserve subsets. These subsets are swapped out for the active subsets as the active subsets are used up as discussed above with reference to FIG. 4. Central computer 25 shown in FIG. 8 uses active game record subsets 101sub3 and 101sub4. The reserve subsets on central computer 25 are subsets 102sub3 and 102sub4. Should central computer 25 use up its active subsets and then designate the reserve subsets 102sub3 and 102sub4 as the new active subsets, central computer 25 would then request new subsets to use as reserves, for example subsets 101sub5 and 101sub6 (not shown in FIG. 8).

The preferred form of the invention may include a progressive feature in a given game. In order to implement the progressive feature, a given percentage of each wager made in the game is added to a progressive prize amount. The progressive prize amount is stored in a data base entry at data base computer 21 for the particular game. The progressive prize amount may be accumulated gradually as game records from the game set are drawn in the course of play.

Gaming system 10 is not limited to any particular games. The result displays produced at the various player terminals may mimic casino-type games such as roulette, slots, blackjack, poker, or keno. Alternatively, the game displays may be totally unrelated to casino-type games. The invention is not limited to any particular type of game as long as the game results may be represented in a game record distributed from a group or set of game records.

FIG. 1 indicates that gaming system 10 comprises a number of processing devices 20 through 26. Specific numbers of other elements such as player terminals or stations 38 are shown in FIG. 1 in order to illustrate an exemplary embodiment of the invention. It will be appreciated that the specific numbers of player terminals 38, POS terminals 35, RPOS terminals 36, and kiosks 37 which may be included in each casino floor subset according to the invention is not limited by FIG. 1. Also, the invention is not limited to three central computers as shown in FIG. 1. Rather, one of the advantages of the present distributed account based gaming system is that it is readily scalable to increase or decrease the number of central computers and thus the number of casino floor devices supported by the system. Furthermore, any processing device utilized in the gaming system may include multiple discrete processing devices as shown or fewer discrete processing devices. Specific processing tasks may be distributed to processing devices throughout the system as consistent with the demands on the system and security objectives, and the invention is not limited by the particular arrangement of processing devices shown in FIG. 1 for purposes of example. In particular the functions performed by the management computer 22 may be performed on another processing device in the system and the separate management computer 22 may be eliminated. The same is true for the separate archive computer 23 and other distinct processing devices shown in FIG. 1.

The above described preferred embodiments are intended to illustrate the principles of the invention, but not to limit the scope of the invention. Various other embodiments and modifications to these preferred embodiments may be made by those skilled in the art.

What is claimed is:

1. A method including:

(a) storing a group of game records and a reserve group of game records at a storage device, each respective game record being associated with a game result for that respective game record;

(b) in response to a game play request, reading a selected game record from the group of game records and notifying a respective player associated with the game play request of the game result associated with the selected game record from the group of game records;

(c) modifying a stored account balance for the respective player associated with the game play request, the stored account balance modification being made in accordance with the game play request and in accordance with the game result associated with the selected game record from the group of game records;

(d) in response to a subsequent game play request received after a certain amount of game records from the group of game records have been used, reading a selected game record from the reserve group of game records, and notifying a respective player associated with the subsequent game play request of the game result associated with the selected game record from the reserve group of game records; and (e) modifying a stored account balance for the respective player associated with the subsequent game play request, the stored account balance for the respective player associated with the subsequent game play request being modified in accordance with the subsequent game play request and in accordance with the game result associated with the selected game record from the reserve group of game records.

2. The method of claim 1 wherein the step of storing the group of game records and the reserve group of game records is performed at a respective computer and the step of modifying each stored account balance is performed at a database computer separate from the respective computer.

3. The method of claim 2 further including the steps of storing a set of game records at a manufacturing computer and dividing the set of game records into multiple subsets of game records.

4. The method of claim 3 wherein the group of game records and the reserve group of game records each comprise a respective subset of game records selected from the set of game records.

5. A method including:

(a) producing a number of game records at a manufacturing computer;

(b) communicating a first subset of the game records from the manufacturing computer to a first central computer and storing the first subset of game records at the central computer;

(c) storing a number of player accounts at a database computer separate from the manufacturing computer and separate from the first central computer, each player account being associated with a respective player and having a respective account balance; and (d) in response to a game play request for a first player having a respective player account, reading a selected one of the game records stored at the first central computer, modifying the respective player account for the first player at the database computer in accordance with the game play request and a result associated with the selected game record, and notifying the first player of the result associated with the selected game record.

6. The method of claim 5 further including communicating a second subset of game records to a second central computer located at a gaming facility where the first central computer is also located.

7. The method of claim 6 further including, in response to a game play request for a second player having a respective player account, reading a respective one of the game records stored at the second central computer, modifying the respective player account for the second player at the database computer in accordance with the game play request and a result associated with the respective game record, and notifying the first player of the result associated with the respective game record.

8. The method of claim 5 further including:

(a) in response to player information received at the first central computer, creating a respective account for a player associated with the player information, the account being created at the database computer; and (b) in response to additional player information received at the second central computer, creating a respective account for the player associated with the additional player information, the account for the player associated with the additional player information being created at the database computer.

9. The method of claim 5 further including:

(a) in response to a first added funds value received at the first central computer, modifying a respective account associated with the first added funds value at the database computer; and (b) in response to a second added funds value received at the second central computer, modifying a respective account associated with the second added funds value at the database computer.

10. The method of claim 5 further including:

(a) in response to a first cash out request received at the first central computer, cashing out a respective account associated with the first cash out request at the database computer; and (b) in response to a second cash out request received at the second central computer, cashing out a respective account associated with the second cash out request at the database computer.

11. A gaming system including:

(a) a first central computer having a game record storage device storing a first group of game records;

(b) a database computer in communication with the first central computer, the database computer having a database storage device storing a number of player accounts, each player account associated with a respective player;

(c) a number of first player terminals in communication with the first central computer, each first player terminal for transmitting a respective player account modification request to the first central computer; and (d) wherein the first central computer is configured to respond to a received player account modification request by directing the database computer to modify a respective player account associated with the received player account modification request.

12. The gaming system of claim 11 further including a manufacturing computer in communication with the first central computer, the manufacturing computer having a respective storage device for storing a number of subsets of game records, each subset being divided from an initial set of game records.

13. The gaming system of claim 12 further including:

(a) a second central computer in communication with the manufacturing computer and having a second game record storage device storing a second group of game records, the second group of game records comprising a respective one of the subsets initially stored at the manufacturing computer, and the second central computer being located at a gaming facility at which the first central computer is also located;

(b) a number of second player terminals in communication with the second central computer, each second player terminal for transmitting a respective player account modification request to the second central computer; and (c) wherein the second central computer is configured to respond to a given player account modification request from one of the second player terminals by directing the database computer to modify a respective player account associated with the given player account modification request.

14. The gaming system of claim 11 wherein the first game record storage device associated with the first central computer stores a first reserve group of game records in addition to the first group of game records and wherein the first central computer is adapted for selecting a game record from the first reserve group of game records once a certain number of game records have been used from the first group of game records.

* * * * *